US006892620B2

(12) United States Patent
Kapiloff

(10) Patent No.: US 6,892,620 B2
(45) Date of Patent: May 17, 2005

(54) ELECTRO-MECHANICAL ROLL PRODUCT DISPENSER

(75) Inventor: David Kapiloff, Gainesville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 22 days.

(21) Appl. No.: 10/025,206

(22) Filed: Dec. 19, 2001

(65) Prior Publication Data

US 2003/0110911 A1 Jun. 19, 2003

(51) Int. Cl.[7] ..... B26D 5/00; B65H 20/00

(52) U.S. Cl. ..... 83/649; 225/14; 225/51; 225/82; 242/564.4; 242/563; 242/564.1; 242/554.5; 242/554.2; 312/34.8

(58) Field of Search ..... 83/648–650, 337–339, 83/209, 364, 365, 367, 401; 225/10, 14, 12, 15, 67, 82, 89, 91, 51, 47, 8, 16; 242/553, 554, 554.2, 554.5, 562, 563, 563.2, 565, 564, 564.4, 564.1

(56) References Cited

U.S. PATENT DOCUMENTS

| | | | | | |
|---|---|---|---|---|---|
| 1,981,229 | A | * | 11/1934 | Gillet | 226/46 |
| 3,715,085 | A | * | 2/1973 | Kobayashi et al. | 83/649 |
| 3,730,409 | A | | 5/1973 | Ratti | |
| 3,737,087 | A | * | 6/1973 | Rooklyn | 226/110 |
| 3,896,691 | A | * | 7/1975 | Granger et al. | 83/335 |
| 3,949,918 | A | | 4/1976 | Golner et al. | |
| 3,951,485 | A | * | 4/1976 | Schnyder et al. | 312/34.12 |
| 3,998,308 | A | | 12/1976 | Yeakley | |
| 4,666,099 | A | * | 5/1987 | Hoffman et al. | 242/564.1 |
| 4,676,131 | A | | 6/1987 | Cassia | |
| 4,721,265 | A | | 1/1988 | Hawkins | |
| 4,738,176 | A | | 4/1988 | Cassia | |
| 4,790,490 | A | | 12/1988 | Chakravorty | |
| 4,796,825 | A | | 1/1989 | Hawkins | |
| 4,960,248 | A | | 10/1990 | Bauer | |
| 5,131,302 | A | * | 7/1992 | Watanabe | 83/62 |
| 5,452,832 | A | | 9/1995 | Niada | |
| 5,772,291 | A | | 6/1998 | Byrd | |
| 6,079,305 | A | | 6/2000 | Bloch et al. | |
| 6,105,898 | A | | 8/2000 | Byrd et al. | |
| 6,293,486 | B1 | * | 9/2001 | Byrd et al. | 242/564.1 |
| 6,354,533 | B1 | * | 3/2002 | Jespersen | 242/560.1 |
| 6,412,655 | B1 | * | 7/2002 | Stuetzel et al. | 221/13 |
| 6,412,679 | B2 | * | 7/2002 | Formon et al. | 225/14 |
| 2002/0117578 | A1 | * | 8/2002 | Denen et al. | 242/563 |

FOREIGN PATENT DOCUMENTS

| | | |
|---|---|---|
| WO | WO 9959457 | 11/1999 |
| WO | 0063100 | 10/2000 |
| WO | PCT 0063100 | 10/2000 |

OTHER PUBLICATIONS

Co–pending U.S. application No. 10/027,785, Filed Dec. 20, 2001.

International Preliminary Examination Report, Mar. 26, 2004.

* cited by examiner

*Primary Examiner*—Boyer D. Ashley
(74) *Attorney, Agent, or Firm*—Dority & Manning

(57) ABSTRACT

An electro-mechanical roll towel dispenser includes a housing with a roll carrier disposed therein to rotationally support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing, and a second electrical operational mode wherein a measured length of a next sheet is automatically and electrically fed out of the housing to define the tail for the next user.

22 Claims, 3 Drawing Sheets

ELECTRO-MECHANICAL ROLL PRODUCT DISPENSER

BACKGROUND OF THE INVENTION

The present invention relates to a dispenser for a roll of web material, and particularly to a sanitary dispenser that dispenses a measured amount of material upon a user grasping and pulling the "tail" end of the roll material.

A number of dispensing devices are well known in the art for dispensing and cutting webs or roll material such as paper toweling. With such dispensers, the process of dispensing and cutting the web material is carried out automatically by a user pulling on the free "tail" end of the web material that extends from a dispensing slot in the apparatus. In a typical configuration, the web material is engaged against a rough friction enhancing surface of a feed drum and the action of pulling the web tail causes the drum to rotate. The drum includes a drive mechanism and, after the initial pull on the web tail by a user, the drum is driven a predetermined rotational degree to dispense a metered amount of the material. A cam driven cutting mechanism may be provided in the rotating drum that pivots out of a slot in the drum to automatically cut the web at the proper length. The dispensers typically include a stored energy mechanism, such as an eccentric cam, that is spring loaded during the initial rotation of the feed drum. This device causes the drum to continue to rotate after the web has been cut. This action causes an additional length of the web material to be feed out of the dispensing slot as the tail for the next dispensing sequence. These types of dispensers are commonly referred to as "no-touch" or "sanitary" dispensers because the user does not manually operate any portion of the drive or cutting mechanism. The user only touches the tail end of the web material.

Although effective, the conventional mechanical sanitary dispensers utilizing automatic mechanical cutting and feeding mechanisms can be relatively complicated from a mechanical component standpoint and expensive to manufacture and maintain. Also, some users have noted that such dispensers present an inordinate amount of resistance to pulling a towel from the dispenser. This may be particularly true when the initial pulling action by the user also provides the force needed to load the potential energy spring of the automatic tail feeding mechanism. Thus, web materials with relatively high tensile strength must be used with such dispensers.

Advances have been made in the art relating to purely electronic sanitary towel dispensers. With such dispensers, the unit is typically activated upon detection of motion of a user's arm or hand. A motor is subsequently energized through a control circuit and power source to drive a feed roll and thus dispense a measured length of material. The user then grabs the exposed material and pulls it at some angle to the dispenser cover causing the sheet of material to separate on a cutting edge or serrated tear bar. The cycle is repeated for the next user.

U.S. Pat. No. 3,730,409 discloses an electronic dispenser wherein initially a full measured length of towel hangs out of the dispenser. A user grabs and separates the towel by pulling it against a tear bar. A force activated switch is configured with the tear bar that activates a dispenser motor through a power source and electronic circuit upon the user tearing the towel. The motor then drives a feed roll to deliver a full measured length of towel material outside of the dispenser cabinet where it hangs for the next user to grab and tear. WO 00/63100 describes an electronic dispenser with a similar operating principle.

A significant drawback with conventional electronic dispensers is that electrical power is consumed by the motor to drive the full length of towel material from the dispenser. This greatly reduces the battery life of such systems resulting in frequent battery replacement and maintenance.

The present invention relates to a hybrid mechanical/electrical sanitary dispenser that addresses at least some of the drawbacks of conventional mechanical and electrical dispensers.

SUMMARY

Objects and advantages of the invention will be set forth in part in the following description, or may be obvious from the description, or may be learned through practice of the invention.

The present invention provides a dispenser for dispensing measured sheets from a roll of web material. The dispenser is not limited to dispensing any particular type or rolled web material, but is particularly useful for dispensing measured sheets of towel material and will be referred to herein as a towel dispenser for ease of explanation. The dispenser is a "sanitary" or "no-touch" dispenser in that the user simply pulls on a tail of the material extending out of the dispenser to dispense a measured sheet and need not activate or manually manipulate a dispensing mechanism.

The dispenser includes a housing of any shape, configuration, or aesthetic appearance. A roll carrier is disposed in the housing for rotationally carrying a roll of the towel material. A dispensing slot is defined in the housing through which measured sheets of the towel material are dispensed. A measured length of the towel material extends out of the dispensing slot and defines a "tail" that a user grasps and pulls in order to dispense of sheet of the material.

An electromechanical feed mechanism is disposed in the housing through which the towel material passes in its running path through the dispenser. The feed mechanism has a first mechanical mode of operation wherein measured sheets are dispensed by a user simply grasping and pulling on the tail extending from the dispensing slot. This pulling action is not used in any way to build up energy or spring load a potential energy feed device or cutter of any sort. Thus, the pulling action meets with little resistance from the feed mechanism since the pull force is primarily the unwind resistance of the material roll. The feed mechanism has a second electrical operational state that is triggered after the sheet has been severed to automatically drive the feed mechanism with an electrically powered motor to dispense a measured length of the towel material out of the dispensing slot to define the tail of the next sheet to be pulled by a user. A control circuit is configured with the motor and feed mechanism to automatically switch the feed mechanism between its operational states at the correct time in the dispensing sequence.

In one embodiment of the invention, the feed mechanism includes a feed roller drivingly engaged by the motor in the second operational state. The feed roller is freely rotatable in the first operational state to the extent that it does not impede a user from manually pulling a measured sheet of the towel material from the dispenser. The feed roller may be mechanically coupled to the motor by any number of various configurations. For example, the motor may drive a small friction roll that engages the surface of the feed roller to rotate the feed roller. The motor may be geared to the feed roller, or a clutch mechanism may be used to couple the motor to the feed roller. A pressure roller may be disposed in opposition to the feed roller to define a nip through which the sheet material passes.

After the user has pulled a measured length of towel material from the dispenser, the material is clamped by the feed mechanism to allow the user to subsequently tear or sever the material into a measured sheet. One means to accomplish this is with the embodiment wherein the feed mechanism includes a driven feed roller and associated pressure roller. Once the correct amount of towel material has passed between the rollers, rotation of the feed roller is stopped by any suitable brake mechanism and the towel material is held or clamped between the rollers. A revolution counter, such as a tacho-generator, may be configured with the feed roller to measure the length of towel material by counting revolutions of the feed roller or associated pressure roller. Upon the desired length of material passing between the rollers, the revolution counter sends a signal to the control circuit to stop or brake the feed roller. A blade or tear bar is provided proximate to the dispensing orifice and once the towel material is clamped, the user severs the material by pulling it against the tear bar.

Any number of devices may be utilized to brake the feed roller. In one embodiment, an electric brake may be configured with the motor. The brake is energized to stop the motor shaft from rotating upon receipt of a "brake-on" trigger signal from the revolution counter and control circuit. In one embodiment, the electric brake may comprise a relatively simple solenoid that, when activated, engages a plunger into a recess or hole in the side of the feed roller to prevent any further rotation of the roller. In an alternate embodiment, the feed roller may be coupled to the drive motor through a controllable clutch. The clutch is disengaged while the user pulls the tail and engages when the desired length has been pulled. Once engaged, the clutch prevents further "free-wheeling" of the feed roller and the towel material is clamped between the feed roller and pressure roller.

Mechanical brake mechanisms also exist as an alternative to electrical control of sheet length. For example, various types of geared systems are widely used in the industry to define the length of a dispensed sheet. Such a system is used, for example in the LEV-R-MATIC® roll towel dispenser from Kimberly-Clark Corporation. It should be appreciated that any suitable mechanical system may be used in the present dispenser to define or limit the length of the dispensed sheet of material.

Once the sheet has been severed by the user, the control circuit automatically shifts the feed mechanism to its electrical operational mode. Any number of mechanical or electrical sensors may be used to signal to the circuit that the towel material has been severed. In one embodiment, an electrical sensor is provided with the tear blade to sense movement of the blade upon the user pulling the towel material against the blade. The blade is held in the housing so as to "float" or deflect to at least some degree upon the towel material being pulled against it. The sensor (which can be a relatively simple contact, such as a bayonet type contact, reed switch, etc.) detects the blade motion and generates a "motor-on" trigger signal to a motor power switch. The normally open power switch closes and power is supplied to the motor to drive the feed roller until a measured amount of towel material has been dispensed to define the tail.

A device is provided with the control circuit to determine when the correct tail length has been dispensed. In one embodiment, this device may comprise a revolution counter configured with the feed roller. This counter may be the same counter used to measure the length of a sheet pulled by the user, or may be a separate counter. Once the correct tail length has been dispensed, the counter generates a trigger signal to open the motor power switch.

It should be appreciated that countless configurations of a control circuit and appropriate sensors may be designed by one of ordinary skill in the electronics arts to correctly switch the feed mechanism between its first mechanical operational state and its second electrical operational state. All such variations and configurations are within the scope and spirit of the invention.

The invention will be described in greater detail below by reference to embodiments thereof illustrated in the figures.

DETAILED DESCRIPTION

Figure 1:
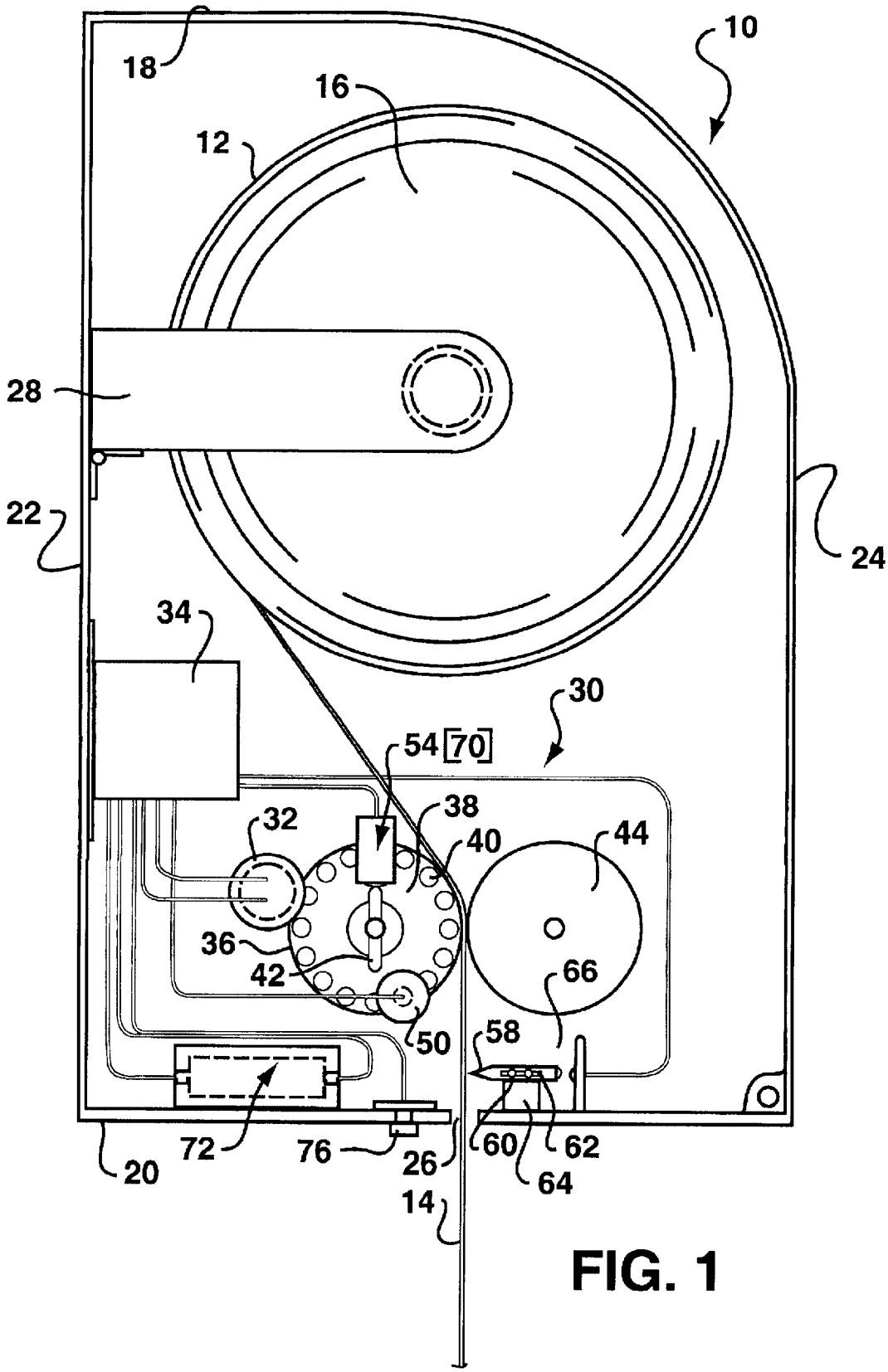
FIG. 1 is cross-sectional diagrammatic view of an embodiment of an electro-mechanical roll product dispenser according to the invention.

Reference will now be made in detail to embodiments of the present invention, at least one example of which is illustrated in the Figs. Each embodiment is provided by way of explanation of the invention, at not meant as a limitation of the invention. For example, features illustrated or described as part of one embodiment may be used with another embodiment to yield still a further embodiment. It is intended that the present invention include these and other modifications and variations as come within the scope and spirit of the invention.

An embodiment incorporating basic operational features of a dispenser according to the present invention is indicated as a dispenser 10 in the figures. The dispenser 10 is configured to dispense a primary roll 12 of towel material 16 that may comprise, for example, a standard eight-inch towel roll. The dispenser 10 includes a housing 18 of any general shape and configuration. The housing 18 includes a bottom portion 20, a front portion 24, and a back portion 22. The dispenser 10 may be mounted to a vertical supporting wall structure by any conventional means. A dispensing slot 26 is defined at an appropriate location in the housing 18. In the illustrated embodiment, the dispensing slot 26 is provided generally in the middle of the bottom portion 20. It should be understood that the dispensing slot 26 may be disposed at various locations in the housing depending on the conveying path of the towel material 16 and configuration of the internal components of the dispenser 10. The dispensing slot is disposed so that a user can see a tail 14 of the towel material extending therefrom and has easy access to grasp and pull the tail 14.

It should be appreciated that the dispenser 10 according to the invention is not limited in its construction by any particular type of materials. For example, the back portion 22 and/or bottom portion 20 may be formed as a sheet metal assembly and the front portion 24 may comprise a removable or pivotal plastic assembly.

The roll 12 is rotatably disposed in the housing 18 by any manner of suitable carrier, such as the side arms 28 disclosed in FIG. 1. Various configurations of carrier mechanisms are know in the art for rotatably supporting a roll of material in a dispenser, and any such device may be used with the present invention.

The dispenser 10 incorporates an electromechanical feed mechanism, generally 30. The towel material 16 passes through the feed mechanism 30 in its running path through the dispenser housing 18. As will be described in greater detail herein, the feed mechanism 30 operates in a first mechanical mode of operation wherein measured sheets of the towel material 16 are dispensed by a user simply grasping and pulling on the tail 14 extending from the dispensing slot 26. The feed mechanism 30 operates in a second electrical mode that is triggered after the sheet has been severed by the user to automatically drive the feed mechanism 30 with an electrically powered motor 32 to dispense a measured length of the towel material 16 out of the dispensing slot 26. This measured length of material becomes the tail 14 of the next sheet to be pulled by a user. As described in greater detail below, a control circuit 34 is configured with the motor 32 and feed mechanism 30 to automatically shift the feed mechanism 30 between its mechanical and electrical modes of operation at the correct time in the dispensing sequence.

In the illustrated embodiment of the dispenser 10, the feed mechanism 30 includes a feed roller 36 rotatably mounted in the housing 18 by any conventional mounting mechanism. The feed roller 36 is drivingly engaged by the motor 32 in the second operational state of the feed mechanism. The feed roller 36 may be engaged by the motor by any one of a number of conventional devices. For example, the feed roller 36 may be directly geared to the output shaft of the motor 32. In an alternate embodiment, a clutch mechanism may be operably disposed between the motor 32 and the feed roller 36. In a relatively simple and inexpensive embodiment illustrated in the figures, the motor 32 directly drives a friction roll 46. The friction roll 46 is engaged against the surface of the feed roller 36 such that rotation of the friction roll 46 causes corresponding rotation of the feed roller 36. This embodiment does not require gears or a clutch mechanism and thus may be preferred from a manufacturing and cost standpoint. However, it should be appreciated that any mechanical coupling between the drive motor 32 and the feed roller 36 is within the scope and spirit of the invention.

A pressure roller 44 is disposed in opposition to the feed roller 36 and defines a nip with the feed roller 36 through which the towel material 16 passes, as particularly illustrated in FIG. 1.

The feed roller 36 is "freely" rotatable in its first operational state to the extent that it does not impede a user from manually pulling a measured sheet of the towel material 16 from the dispenser. It should be understood that it is not necessary that the feed roller 36 "free-wheel." For example, in the illustrated embodiment, the feed roller 36 remains in contact with the friction roll 46 while a user pulls the towel material 16 between the feed roller 36 and pressure roller 44. The friction roll 46 and the shaft of the motor 32 will thus also rotate. However, the friction roll 46 and motor 32 do not exert enough resistance to prevent the feed roller 36 from freely rotating as the user pulls the tail 14. In an embodiment wherein a clutch is disposed between the motor 32 and feed roller 36, the clutch would be disengaged in the first operational state of the feed mechanism 30 and, thus, the feed roller 36 would actually free-wheel in the first operational state. In an embodiment wherein the motor 32 is directly geared to the feed roller 36, the gearing and motor 32 would offer some resistance, but would not impede the ability of the user to pull the tail of material in order to dispense a measured sheet of the material.

After the user has pulled a measured length of the towel material 16 from the dispenser 10, the material 16 is clamped by the feed mechanism 30 in order to allow the user to subsequently tear or sever the material by pulling the material against a tear blade or bar 58 mounted proximate to the dispensing slot 26. The clamping feature may be carried out by various devices. In the illustrated embodiment wherein the feed mechanism 30 includes a feed roller 36 and pressure roller 44, the feed roller 36 is stopped by a brake mechanism 48 (FIG. 2) once the correct measured amount of towel material 16 has passed between the rollers. Various mechanical, electrical, or electromechanical brake devices can be utilized in this regard. For example, an electric brake may be applied directly to the shaft of the motor 32. In an embodiment wherein a clutch is disposed between the motor 32 and feed roller 36, the "brake mechanism" may comprise the clutch that, once engaged, prevents free-wheeling of the feed roller 36. A consideration is that the brake mechanism not unnecessarily drain the power source, particularly if the power source is disposable batteries. In this regard, a relatively simple brake 48 is illustrated in the figures as a solenoid 50 that actuates a plunger 52. Referring particularly to FIG. 3, the feed roller 36 has an end face 38 with a series of recesses or holes 40 disposed around the circumference of the end face 38. The solenoid 50 is aligned so that upon actuation of the solenoid, the plunger 52 engages against the face 38 and extends into the next recess 40 in the direction of rotation of the roller 36. The trigger signal is sent to the solenoid 50 upon the correct measured length of towel material 16 passing between the feed roller 36 and pressure roller 44. An embodiment such as this may be desired in that the only power necessary to actuate the solenoid 50 is an initial trigger signal that causes the plunger 52 to move into engagement with the recesses 40. Once the plunger has moved into a recess 40, it is not necessary to supply power to the solenoid 50. Likewise, to release the brake, a release signal is sent to the solenoid 50 causing the plunger 52 to retract and thus release the feed roller 36.

Figure 2:
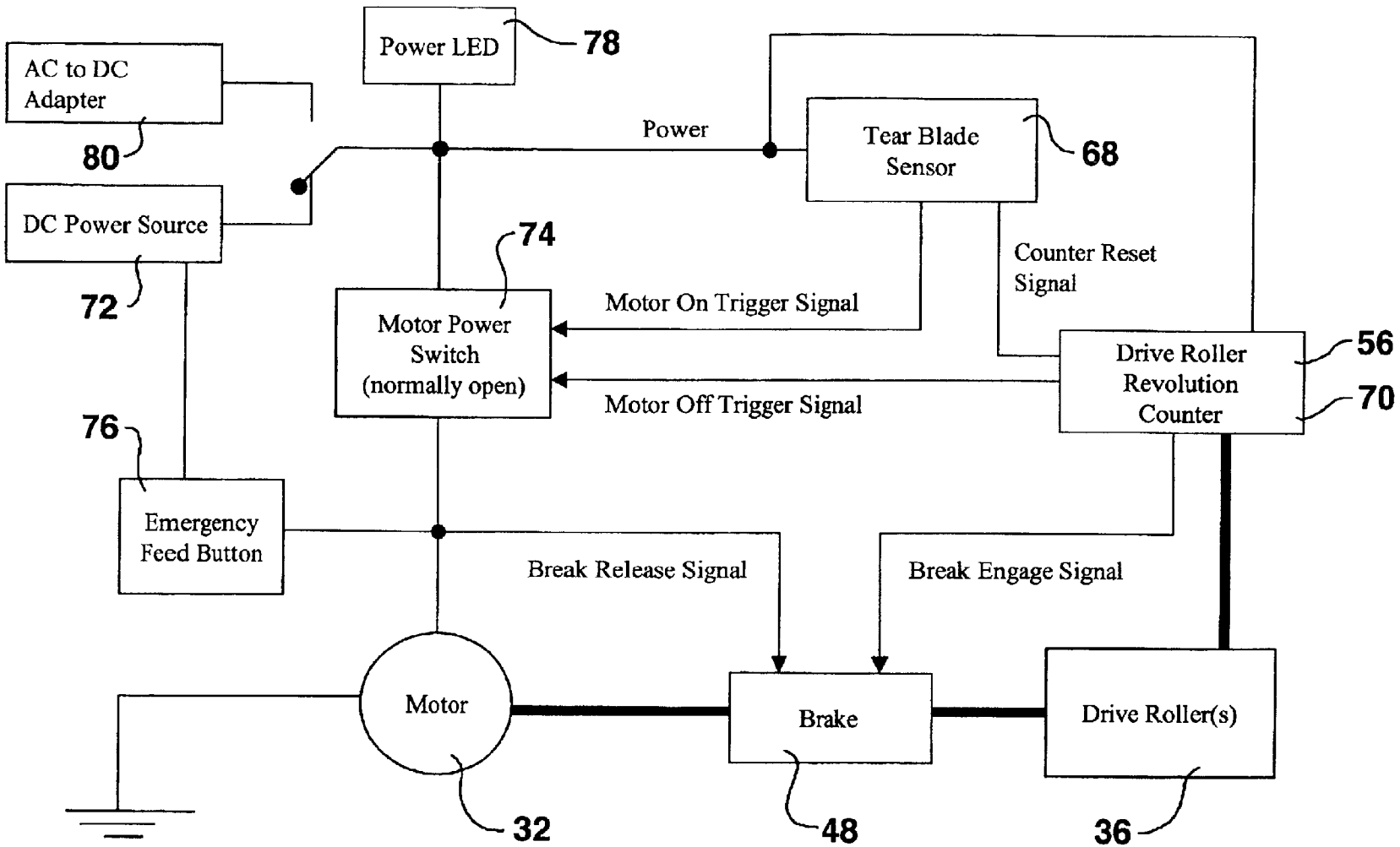
FIG. 2 is a diagram of exemplary control components of the embodiment of FIG. 1.
Figure 3:
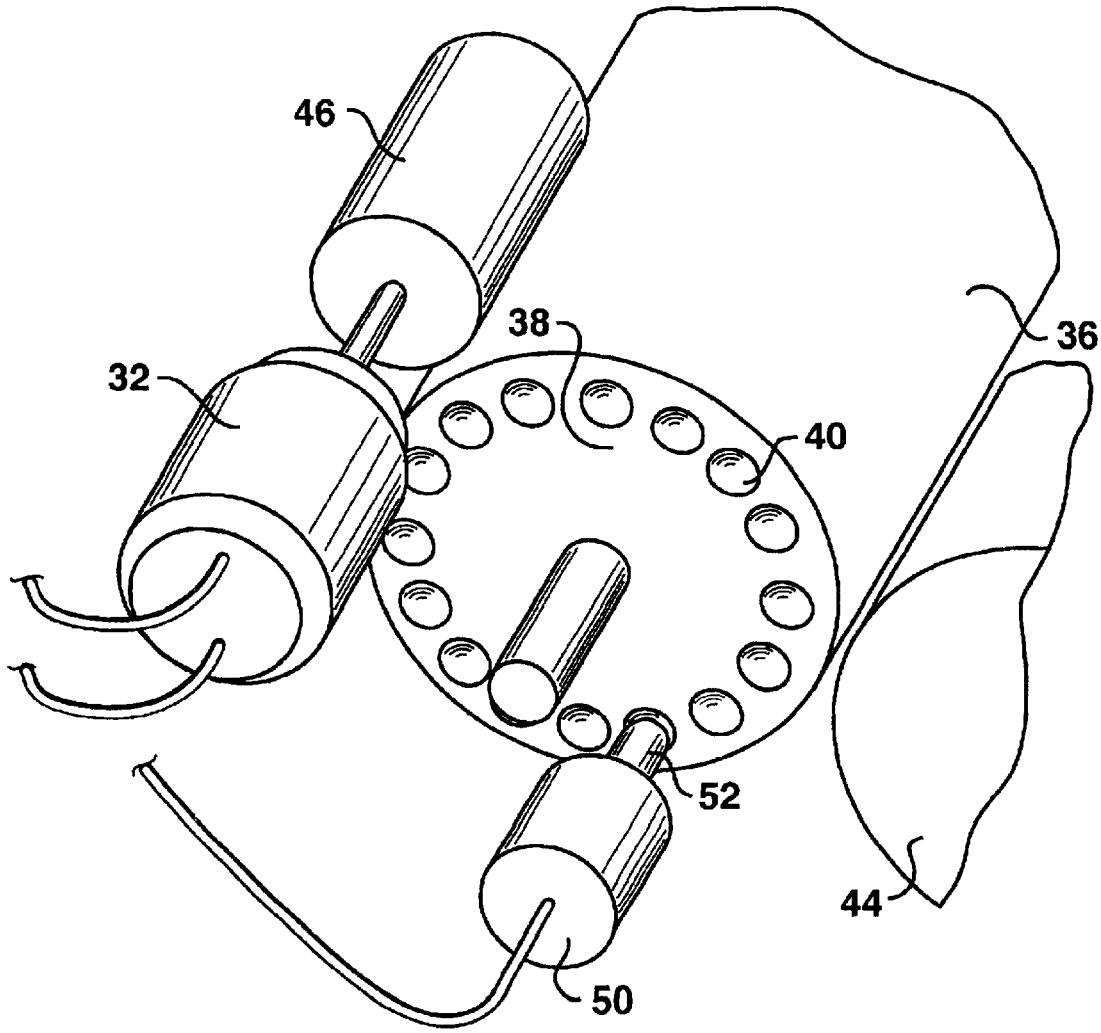
FIG. 3 is an enlarged perspective view of one suitable arrangement for mechanically coupling a feed roller to an electric motor for use in the present invention.

Referring particularly to FIGS. 1 and 2, a brake trigger device, generally 54, is provided to trigger and engage the brake 48 once the correct length of towel material 16 has passed between the rollers. In the illustrated embodiment, the trigger device 54 includes a revolution counter 56, such as a typical tacho-generator, that is configured with the feed roller 36 to measure the length of towel material 16 passing between the feed roller 36 and pressure roller 44 by counting the revolutions of the feed roller 36 or pressure roller 44. Referring to FIG. 1, the feed roller 36 includes a vane 42 configured at the end 38 thereof. Revolutions of the vane 42 are detected and counted by the revolution counter 56 and a corresponding signal is forwarded to a control circuit 34. It should be appreciated that the term "control circuit" is used herein to broadly define any combination of relays, switches, power sources, counters, sensors, and the like that route the various signals and actuate the various components of the dispenser 10 in the desired sequence. Once the revolution counter indicates that the required measured length of towel material 16 has passed the feed roller 36, the control circuit 34 triggers the brake 48 to stop rotation of the feed roller 36. In the illustrated embodiment, a signal is simply sent to the solenoid 50 causing the plunger 52 to engage and brake the feed roller 36. Upon braking the feed roller 36, the towel material 16 is clamped between the feed roller 36 and pressure roller 44.

In an alternative embodiment, a mechanical braking and measuring system may be utilized. One such system widely known and used in the art is a gear system wherein the length of the sheet is determined by the arc of a curved rack that is geared to a metering roll. Such a system is used, for example in the LEV-R-MATIC® roll towel dispenser from Kimberly-Clark Corporation. This system utilizes a metering roll with a fixed ring gear on an end thereof that is geared to a curved rack gear by way of a floating pinion gear. The ring gear could be provided on the feed roll or pressure roll in the present dispenser. As the towel material is dispensed, the metering roll rotates and drives the curved rack gear by way of the pinion gear. The length of the sheet is determined by the degree of travel of the curved rack gear. At the stop position of the curved rack gear, the feed roll would be locked and the sheet material clamped thereby. The pinion gear is housed in an angled track and moves within the track to disengage from the ring gear and curved rack gear at the stop position of the rack gear, at which point the rack gear falls back to its start position. This type of system is well known by those skilled in the art and need not be described in great detail herein.

Referring to FIG. 1, a tear blade or bar 58 is disposed within the housing 18 proximate to the dispensing slot 26 so that, once the towel material 16 is clamped, the user can sever the measured length of towel material into a sheet by pulling the towel forward against the tear bar 58.

After the sheet has been severed by the user, the feed mechanism 30 automatically shifts into its second electrical mode of operation to dispense a measured length of the towel material 16 out of the dispensing slot 26 to define the tail 14 for the next subsequent user. To accomplish this, a motor trigger device is used to activate the motor once the sheet has been severed. Various devices may be used to sense that the sheet has been torn by the user. In the embodiment illustrated in the figures, the tear blade 58 "floats" on a carrier 64 to a certain degree so that the blade 58 is caused to move or deflect upon the user pulling the towel material 16 against the blade 58. In the illustrated embodiment, the blade 58 includes an elongated slot 62 engaged by protrusions 60 on the carrier 64. The tear bar 58 thus floats to the extent permitted by engagement of the protrusions within the slot. A sensor, generally 68, detects motion or deflection of the tear bar 58 and sends a corresponding signal to the control circuit 34. In the illustrated embodiment, the sensor 68 is a relatively simple contact arrangement between a stationary contact and the end of the tear blade 58.

The control circuit 34 may include a normally open motor power switch 74 (FIG. 2). The signal from the tear blade sensor 68 acts as a trigger signal to close the motor power switch 74 and energize the motor 32 in order to feed a measured length of the towel material 16 out of the dispensing slot 26.

Referring to FIG. 2, a brake release signal is generated once the towel material 16 has been severed to disengage the brake to allow for the subsequent automatic feeding of the tail 14. In the illustrated embodiment, the brake release signal corresponds essentially to the motor-on trigger signal that results in closing of the motor power switch 74. In other words, upon power being supplied to the motor, a brake release signal is simultaneously sent to the brake 48. In the embodiment wherein the brake 48 includes a solenoid 50, the brake release signal simply causes the plunger 52 to retract. Once the brake 48 is disengaged, the feed roller 36 is driven by the motor 32 to dispense the measured amount of tail material.

A motor-off trigger device is provided to stop the motor 32 upon the measured amount of tail material being fed out of the dispensing slot 26. This trigger device may comprise various devices. In the illustrated embodiment, the trigger device is a revolution counter 70 configured to detect the number of revolutions of the feed roll 36. This revolution counter 70 may be the same revolution counter 54 used as the brake trigger device, as discussed above. In operation, the revolution counter 70 sends a signal to the control circuit 34 once the desired amount of tail material has been dispensed to cause the motor power switch 74 to open and thus deenergize the motor 32.

Referring to FIGS. 1 and 2, a power supply 72 is contained within the housing 18 to power the various electronic components and control circuit. The power source 72 may include a battery compartment for disposable DC batteries. Referring particularly to FIG. 2, and AC to DC adapter 80 may be utilized to provide an alternate source of power to the dispenser. This embodiment may be particularly useful wherein the dispenser 10 is mounted in close proximity to an AC outlet.

An emergency feed button 76 (FIGS. 1 and 2) may also be provided with the dispenser 10 as a way for a technician to bypass the circuitry and energize the motor 32 for driving a length of the towel material from the dispenser. This may be necessary, for example, when the tail 14 has become jammed within the dispenser and does not extend out of the dispensing slot 26.

Referring again to FIG. 2, the dispenser 10 may also incorporate a device to indicate to a user or technician that power is available to the dispenser. This device may be a relatively simple light or LED display 78 that is illuminated so long as power is available. Any number or suitable indicators may be used in this regard.

It should also be appreciated that a dispenser 10 according to the invention may incorporate any combination of additional features found on conventional hands-free dispensers. For example, the dispenser may include an emergency manual feed device such as a manual hand wheel or knob. The dispenser may be configured to dispense a stub roll in addition to a primary roll. Any combination of such additional features is within the scope and spirit of the invention.

It should be appreciated by those skilled in the art that various modifications and variations can be made to the embodiments of the invention illustrated and described herein without departing from the scope and spirit of the invention.

What is claimed is:

1. An electro-mechanical roll towel dispenser for dispensing measured towel sheets from a roll of the towel material, comprising:

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein a sheet of towel material is dispensed by a user grasping and pulling on a tail of the towel sheet extending from said dispensing slot, and means for automatically dispensing an additional measured length of the towel material in a second electrical operational state wherein the additional measured length of the towel material is electrically and automatically fed out of said dispensing slot after the sheet of towel material is severed to define a tail of a subsequent sheet of towel material;

a motor disposed in said housing to drive said feed mechanism in said second electrical operational state.

2. The dispenser as in claim 1, further comprising a control circuit operably configured with said motor and said feed mechanism to automatically switch said feed mechanism between said first and second operational states.

3. The dispenser as in claim 1, wherein said feed mechanism comprises a feed roller driven by said motor in said second operational state of said feed mechanism and freely rotatable in said first operational state of said feed mechanism, and a pressure roller opposing said feed roller, the towel material passing between said feed roller and said pressure roller.

4. An electro-mechanical roll towel dispenser for dispensing measured towel sheets from a roll of the towel material, comprising:

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein a sheet of towel material is dispensed by a user grasping and pulling on a tail of the towel sheet extending from said dispensing slot, and a second electrical operational state wherein a measured length of the towel material is electrically and automatically fed out of said dispensing slot to define a tail of a subsequent sheet of towel material;

a motor disposed in said housing to drive said feed mechanism in said second electrical operational state; and further comprising a brake mechanism operably disposed to said feed roller, said brake stopping rotation of said feed roller upon a measured amount of towel material being pulled by a user so that the towel material is then clamped between said feed roller and said pressure roller.

5. The dispenser as in claim 4, wherein said brake mechanism is a mechanical brake.

6. The dispenser as in claim 4, wherein said brake mechanism is electrically actuated and further comprising a brake trigger device to activate said brake upon a measured amount of sheet material being pulled by the user.

7. The dispenser as in claim 6, wherein said brake trigger device comprises a revolution counter operatively configured with said feed roller.

8. The dispenser as in claim 4, further comprising a tear blade disposed in said housing downstream of said feed roller and said pressure roller in a running direction of the towel material whereby after being clamped between said feed roller and pressure roller, the user severs the towel material into a measured sheet by pulling the towel material against said tear blade.

9. The dispenser as in claim 8, further comprising a motor trigger device to activate said motor subsequent to the towel material being severed so that the tail of the next sheet is automatically fed out of said dispensing slot.

10. The dispenser as in claim 9, wherein said motor trigger device comprises a sensor disposed to detect movement of said tear blade upon the user pulling the towel material against said tear blade.

11. The dispenser as in claim 8, further comprising a motor-off trigger device to stop said motor upon a measured amount of towel material being feed out of said dispensing slot to define the tail.

12. The dispenser as in claim 11, wherein said motor-off trigger device comprises a revolution counter operably configured with said feed roller.

13. The dispenser as in claim 1, further comprising a power supply for said motor and a motor power switch, said switch being closed to supply power to said motor upon a measured sheet being severed from the towel material by the user, and being opened upon a measured amount of tail being extended from the dispensing slot by said feed mechanism.

14. An electro-mechanical roll towel disoenser for dispensing measured towel sheets from a roll of the towel material, comprising;

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein a sheet of towel material is dispensed by a user grasping and pulling off a tail of the towel sheet extending from said dispensing slot, and a second electrical operational state wherein a measured length of the towel material is electrically and automatically fed out of said dispensing slot to define a tail of a subsequent sheet of towel material;

a motor disposed in said housing to drive said feed mechanism in said second electrical operational state;

a power supply for said motor and a motor power switch, said switch being closed to supply power to said motor upon a measured sheet being severed from the towel material by the user, and being opened upon a measured amount of tail being extended from the dispensing slot by said feed mechanism; and wherein said feed mechanism comprises a feed roller driven by said motor in said second operational state of said feed mechanism and freely rotatable in said first operational state of said feed mechanism, and a pressure roller opposing said feed roller, the towel material passing between said feed roller and said pressure roller, and a control circuit operably configured with said motor and said feed mechanism to automatically switch said feed mechanism between said first and second operational states, wherein said control circuit further comprises a revolution counter operatively configured with said feed roller to provide a trigger signal to open said motor power switch upon the measured amount of tail being extended from said dispensing slot.

15. The dispenser as in claim 14, further comprising a brake operably disposed between said motor and said feed roller, said revolution counter providing a signal to actuate said brake to stop rotation of said feed roller upon a measured amount of towel material being pulled by a user so that the towel material is then clamped between said feed roller and said pressure roller.

16. The dispenser as in claim 13, wherein said feed mechanism is configured to clamp upon the sheet material upon a measured length of the material being pulled by the user.

17. An electro-mechanical roll towel dispenser for dispensing measured towel sheets from a roll of the towel material, comprising:

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein a sheet of towel material is dispensed by a user grasping and pulling on a tail of the towel sheet extending from said dispensing slot, and a second electrical operational state wherein a measured length of the towel material is electrically and automatically fed out of said dispensing slot to define a tail of a subsequent sheet of towel material;

a motor disposed in said housing to drive said feed mechanism in said second electrical operational state;

a power supply for said motor and a motor power switch, said switch being closed to supply power to said motor upon a measured sheet being severed from the towel material by the user, and being opened upon a measured amount of tail being extended from the dispensing slot by said feed mechanism;

wherein said feed mechanism is configured to clamp upon the sheet material upon a measured length of the material being pulled by the user; and further comprising a tear blade disposed in said housing downstream of said feed mechanism in a running direction of the towel material whereby the user severs the towel material into a measured sheet by pulling the towel material against said tear blade, and a tear blade sensor that detects movement of said tear blade and generates a signal to close said motor power switch.

18. The dispenser as in claim 17, further comprising a sensor configured with said feed mechanism to generate a signal to open said motor power switch upon a measured amount of tail material being extended from said dispensing slot.

19. The dispenser as in claim 18, wherein said feed mechanism comprises a feed roller, said sensor comprising a revolution counter configured with said feed roller.

20. An electro-mechanical roll towel dispenser for dispensing measured towel sheets from a roll of the towel material, comprising:

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein towel sheets are dispensed by a user grasping and pulling on a tail of a towel sheet extending from said dispensing slot, and means for automatically dispensing an additional measured length of the towel material in a second electrical operational state wherein a the additional measured length of the towel material is electrically and automatically fed out of said dispensing slot after the sheet of towel material is severed to define a tail of a subsequent sheet of towel material, said feed mechanism including a feed roller driven in said second operational state of said feed mechanism and freely rotatable in said first operational state of said feed mechanism, and a pressure roller opposing said feed roller, the towel material passing between said feed roller and said pressure roller;

a motor disposed in said housing to drive said feed roller in said second electrical operational state; and a control circuit including a power supply for said motor and a motor power switch, said switch being closed to supply power to said motor upon a measured sheet being severed from the towel material by the user, and being opened upon a measured amount of tail being extended from the dispensing slot by said feed mechanism.

21. An electro-mechanical roll towel dispenser for dispensing measured towel sheets from a roll of the towel material, comprising:

a housing, and a roll carrier disposed in said housing to rotationally support the roll of towel material, said housing further comprising a dispensing slot defined therein through which measured sheets of the towel material are dispensed;

an electro-mechanical feed mechanism disposed in said housing to dispense the sheets of towel material therefrom, said feed mechanism having a first mechanical operational state wherein towel sheets are dispensed by a user grasping and pulling on a tail of a towel sheet extending from said dispensing slot, and a second electrical operational state wherein a measured length of the towel material is electrically and automatically feed out of said dispensing slot to define a tail of a subsequent sheet of towel material, said feed mechanism including a feed roller driven in said second operational state of said feed mechanism and freely rotatable in said first operational state of said feed mechanism, and a pressure roller opposing said feed roller, the towel material passing between said feed roller and said pressure roller;

a motor disposed in said housing to drive said feed roller in said second electrical operational state;

a control circuit including a power supply for said motor and a motor power switch, said switch being closed to supply power to said motor upon a measured sheet being severed from the towel material by the user, and being opened upon a measured amount of tail being extended from the dispensing slot by said feed mechanism; and wherein said control circuit further comprises a revolution counter configured with said feed roller, said revolution counter providing a signal to open said motor power switch upon the measured amount of tail being extended from said dispensing slot.

22. The dispenser as in claim 21, further comprising a brake operably disposed between said motor and said feed roller, said revolution counter providing a signal to actuate said brake to stop rotation of said feed roller upon a measured amount of towel material being pulled by a user so that the towel material is then clamped between said feed roller and said pressure roller.

* * * * *